US005645223A

United States Patent [19]

Hull et al.

[11] Patent Number: 5,645,223

[45] Date of Patent: Jul. 8, 1997

[54] LIQUID/FOAM/MIXING/AERATION ADAPTER APPARATUS

[76] Inventors: Harold L. Hull, 401 Canyon Way #43, Sparks, Nev. 89434; Zack J. Carrillo, P.O. Box 5315, Incline Village, Nev. 89450

[21] Appl. No.: 547,680

[22] Filed: Oct. 19, 1995

[51] Int. Cl.[6] ..... B05B 7/28

[52] U.S. Cl. ..... 239/428.5; 239/433; 239/588; 239/600

[58] Field of Search ..... 239/428, 428.5, 239/433, 8, 9, 343, 373, 533.13, 602, 588, 600

[56] References Cited

U.S. PATENT DOCUMENTS

| | | | |
|---|---|---|---|
| 2,738,962 | 3/1956 | Goodrie | 261/18 |
| 2,739,711 | 3/1956 | Holden | 239/428.5 X |
| 3,957,209 | 5/1976 | Thomson | 239/433 X |
| 3,961,754 | 6/1976 | Kuhns et al. | 239/289 |
| 4,264,212 | 4/1981 | Tookey | 239/433 X |
| 4,669,665 | 6/1987 | Shay | 239/428.5 |
| 4,730,775 | 3/1988 | Mass | 239/120 |
| 4,767,060 | 8/1988 | Shay | 239/401 |
| 4,883,227 | 11/1989 | Mass | 239/120 |
| 4,944,460 | 7/1990 | Steingass | 239/428.5 |
| 5,129,581 | 7/1992 | Braun et al. | 239/414 |
| 5,234,167 | 8/1993 | Martin | 239/343 |
| 5,330,105 | 7/1994 | Kaylor | 239/400 |
| 5,417,371 | 5/1995 | Brackett | 239/391 |

FOREIGN PATENT DOCUMENTS

| | | | |
|---|---|---|---|
| 639408 | 2/1995 | European Pat. Off. | 239/428.5 |
| 7500758 | 7/1976 | Netherlands | 239/428.5 |
| 636410 | 11/1978 | U.S.S.R. | 239/428.5 |
| 926790 | 4/1992 | WIPO | 239/428.5 |

*Primary Examiner*—Kevin Weldon

[57] ABSTRACT

The present invention is "A LIQUID/FOAM/MIXING/AERATION ADAPTER APPARATUS" which is substantially made from an elongated flexible member (which forms a mixing chamber therein) having first and second open ends, with the first end being frictionally attachable to a nozzle and the second end containing an insert for expelling a liquid/foam/air solution therefrom. The member further includes at least two angular cavities which are in open communication with the mixing chamber for aeration and each cavity is of a size and shape to recieve therein a unique adjustable aeration device.

3 Claims, 2 Drawing Sheets

LIQUID/FOAM/MIXING/AERATION ADAPTER APPARATUS

FIELD OF THE INVENTION

The present invention relates to liquid/foam dispenser assemblies which are frictionally attachable to a nozzle, but more particularly to liquid/foam/mixing adapters which include unique aeration means therein.

BACKGROUND OF THE INVENTION

Many attempts have been made to improve existing liquid/foam dispensers due to their many inherent disadvantages, however each of these attempts include additional inherent drawbacks which the present invention addresses and overcomes. The following United States patents are exempliary of such foam dispensers; U.S. Pat. Nos. 5,417,371, 5,234,167, 5,129,581, 4,730,775 and 3,961,754. Each of these references include inherent disadvantages, such as they are not universally adaptable for attachment to various sized nozzles, they do not provide unique adjustable aeration means, they are not made from a flexible material, they have many interior components, they are not economical to manufacture, ect.

OBJECTS AND ADVANTAGES

It is therefore contended by the applicants that a great need exists for a functional, economical, improved "liquid/foam/mixing/aeration adapter apparatus" which expels a combination liquid/foam solution in a controlled manner therefrom, and which is universally attachable to various sized nozzles of choice.

It is therefore an object of the present invention to provide a "liquid/foam/mixing/aeration adapter apparatus" which is frictionally attachable to various sized nozzles of choice.

It is a further object of the present invention to provide a "liquid/foam/mixing/aeration adapter apparatus" which is made from a flexible member, such as a rubber hose, or the like.

It is another object of the present invention to provide a "liquid/foam/mixing/aeration adapter apparatus" which includes a tubular insert therein for expelling a combination liquid/foam/air solution in a controlled manner therefrom.

Still another object of the present invention is to provide a "liquid/foam/mixing/aeration adapter apparatus" which includes a flexible member having at least two substantially opposed angular cavities through substantially its side wall, and each cavity being in open communication with the mixing chamber formed within the flexible tubular member. Yet another object of the present invention is to provide a "liquid/foam/mixing/aeration adapter apparatus" having the above noted cavities therein with each being angled so as to form substantially a venturi tube, whereby, when the foam/liquid solution passes through the mixing chamber, a vacuum is formed causing outside air to be drawn into the mixing chamber through the cavities.

It is still another object of the present invention to provide a "liquid/foam/mixing/aeration adapter apparatus" which includes the above noted cavities having a unique adjustable aeration means positioned therein.

Yet another object of the present invention is to provide a "liquid/foam/mixing/aeration adapter apparatus" which is economical and easily manufactured.

Still a further object of the present invention is to provide a liquid/foam/mixing/aeration adapter apparatus which overcomes and addresses the disadvantages of the known prior art.

Other objects and advantages will be seen when taken into consideration with the following specification and drawings.

SUMMARY OF THE INVENTION

The present invention is a "liquid/foam/mixing/aeration adapter apparatus". The apparatus is substantially formed from a flexible tubular member (such as a rubber hose) having first and second open ends, with the first end being universally attachable over a nozzle of choice, with the second end frictionally retaining a tubular insert therein for expelling a liquid/foam/air solution therefrom. The tubular member forms a mixing chamber therein for receiving and directing a liquid/foam/air solution therefrom. The tubular member further providing unique aeration means therein.

DETAILED DESCRIPTION OF THE DRAWINGS

Referring now in detail to the drawings wherein like characters refer to like elements throughout the various views.

Figure 1:
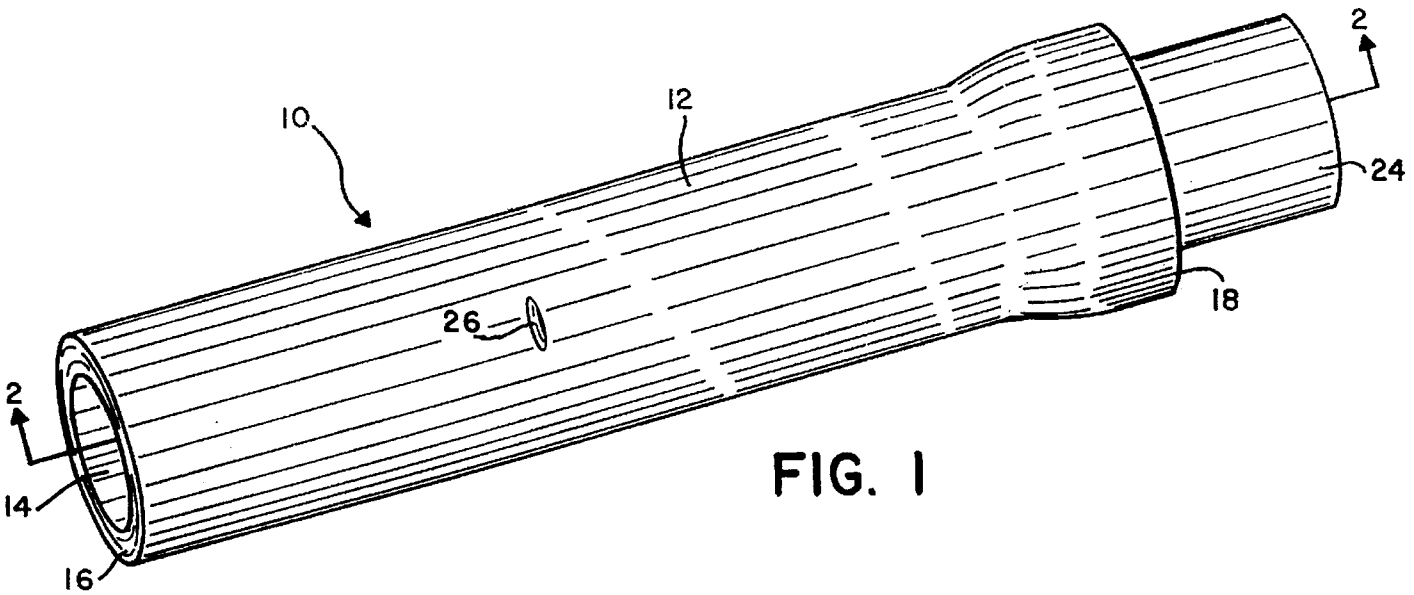
FIG. 1 is substantially a perspective view of the preferred embodiment for the present invention.

Shown in FIG. 1, (10) represents an overview of the "liquid/foam/mixing/aeration adapter apparatus" of the present invention. The apparatus (10) is substantially formed from an elongated flexible tubular member (12), such as a rubber hose or the like, and forms a mixing chamber (14) therein for receiving and directing a liquid/foam/air solution (20) therefrom. Member (12) further having first and second open ends (16) & (18), with the first end (16) being frictionally attachable over a nozzle (22) of choice. It is to be noted that substantially any type of and/or size of pressurized nozzle may be used, such as a nozzle which is mounted at the front end of a body of a hand manipulated pumping apparatus, or the like. The second end (18) of member (12) being of a shape and size to frictionally receive therein a tubular insert (24) for expelling the liquid/foam/air solution (20) therefrom. It is to be noted that the insert (24) may be formed from a flexible material, (such as a hose) or from any other suitable material of choice, such as metal (as we have herein shown) or even plastic, ect. Member (12) further having at least two substantially opposed angular cavities (26) (as shown in FIG. 1) which are in open communication with the mixing chamber (14) and it is to be noted that cavities (26) are angled in a direction of engineering choice.

Referring now to the preferred embodiment of FIG. 1, wherein it will now be seen that when member (12) is frictionally attached to pressurized nozzle (22), and the nozzle (22) injects a liquid/foam solution (28) therefrom into the mixing chamber (14), the solution (28) is forced through the chamber (14) directly past cavities (26), whereby a vacuum is formed when ambient air (x) is drawn into the chamber (14), thereafter, aeration of the liquid/foam solution (28) occurs and subsequently transforms the solution (28) into the liquid/foam/air solution (20), this transformation simultaneously causes the solution to expand within the mixing chamber (14) and become a thick frothy foam, (such as used by fire fighters), thereafter, the foam is forced to travel through chamber (14) into the tubular insert (24), which in turn expels the foam (solution 20) therefrom in a controlled manner.

Figure 2:
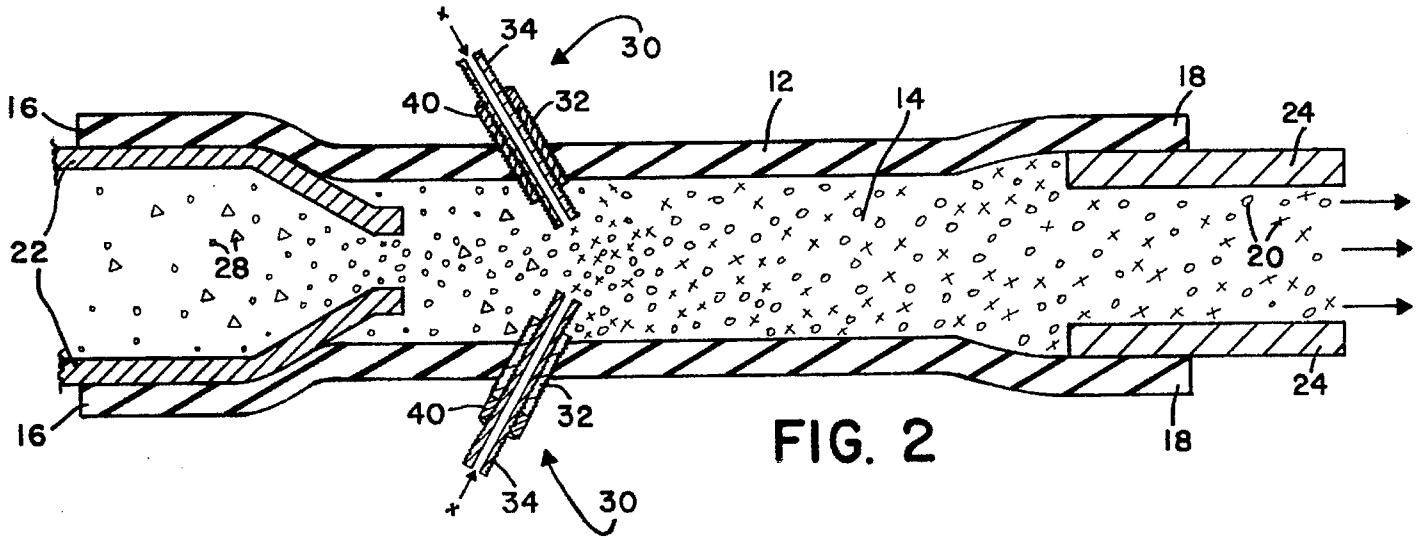
FIG. 2 is substantially a sectional view taken at 2—2 of FIG. 1.
Figure 4:
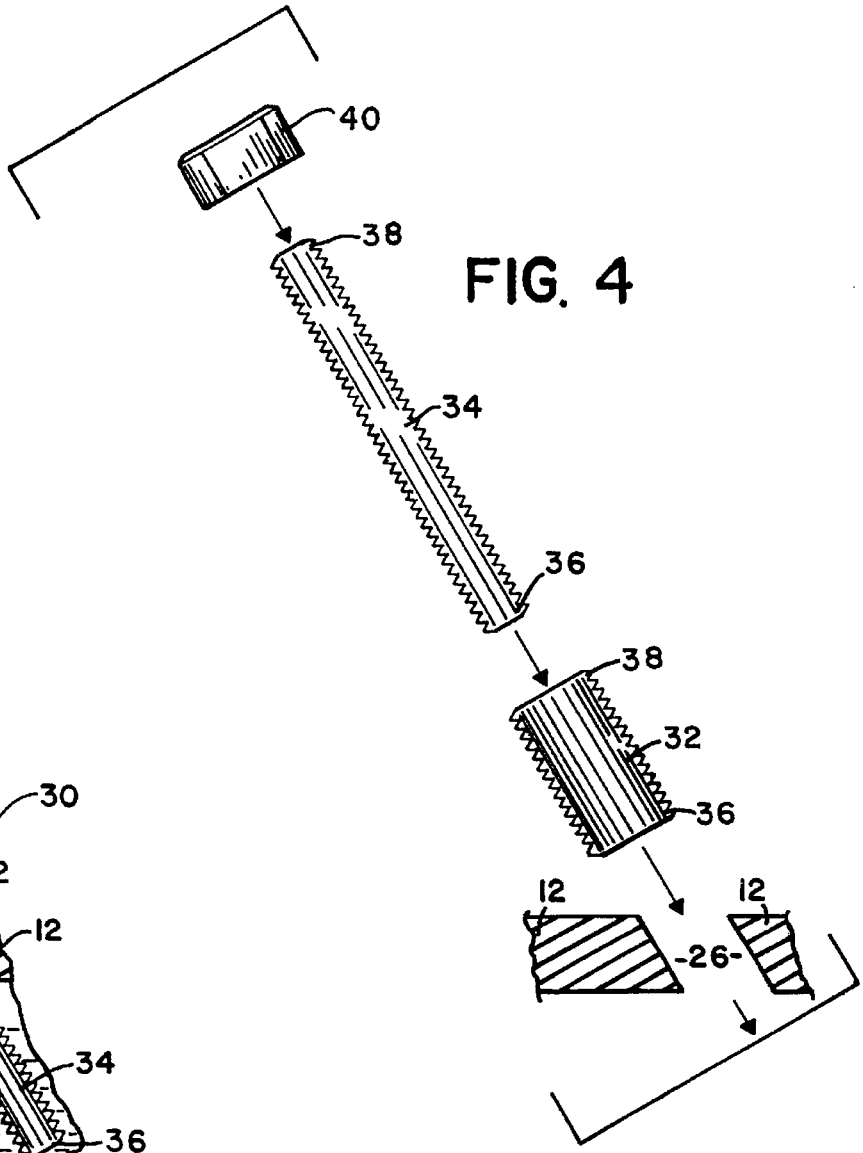
FIG. 4 is substantially an enlarged plan view for installing the aeration means.
Figure 3:
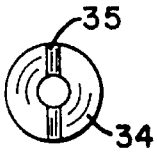
FIG. 3 is substantially an enlarged top view of an elongated second member showing a screwdriver slot therein.
Figure 5:
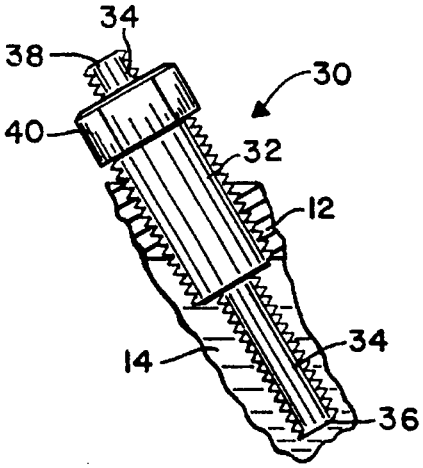
FIG. 5 is substantially an enlarged partial cut-a-way showing the aeration means in a closed first position.
Figure 6:
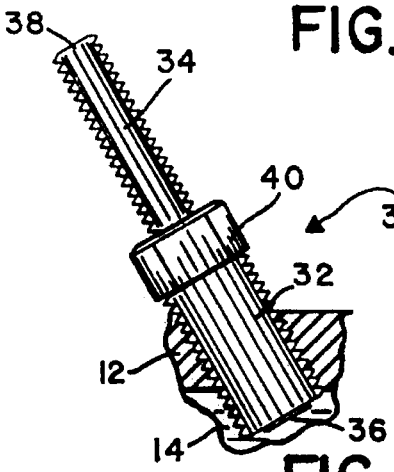
FIG. 6 is substantially an enlarged partial cut-a-way showing the aeration means in a second open position.

Referring now to FIG. 2, wherein we show the embodiment of FIG. 1 further including a unique adjustable aeration means inserted within each of the cavities (26), represented by arrow (30). Aeration means (30) comprising in combination of the following; first and second tubular members (32) and (34), (as shown throughout FIGS. 2–6) which are formed from any suitable material of choice, such as metal, plastic, ect., and members (32) and (34) each having first and second ends, (36) and (38). The first member (32) being of a size and shape to be threadably engaged within one of cavities (26). The first member (32) further being of a size and shape to threadably adjustably receive the second member (34) there through. The second member (34) being of a suitable length so as to extend substantially half way into the mixing chamber (14) when fully engaged within one of cavities (26). The second end (38) of the second member (34) may include a screwdriver slot (35) therein (shown and drawn to a larger scale within FIG. 3), and also the second end (38) of the second member (34) being of a size and shape to threadably receive a nut (40) thereon, and the second end (38) of the first member (34) acting as a stop means for nut (40).

It will now be seen that when the user has attached the member (12) to nozzle (22), and the aeration means (30) (as described above) is inserted within each of the cavities (26), and the user activates the pumping apparatus (not shown), liquid/foam (28) enters the mixing chamber (14) where it is then forced to flow past cavities (26), cavities (26) are angled so that a vacuum is formed from the incoming air (x) which is drawn into and through the mixing chamber (14), therefore areating the liquid/foam solution (28) flowing within the mixing chamber (14), whereby transforming and expanding the solution into liquid/foam/air (20), thereafter, the solution (20) is forced to flow from the mixing chamber (14) into and out of the nozzle (22). If however, the user determines that the liquid flow and/or air mixture is inadequate for the desired results, the user may simply adjust the liquid flow and/or air mixture to their liking, as follows;

If the user determines that less air (x) is needed to further aerate the liquid/foam solution (28), the user simply inserts a screwdriver into slot (35) (found on second member 34) and turns member (34) counter-clockwise (which causes the second member "34" to withdraw from the mixing chamber "14", whereby, allowing for less air to enter chamber "14") and therefore when the end (36) is withdrawn out of and away from the main stream of liquid which flows less rapidly near the sidewalls, it will not react as much to the vacuum action of the liquid flow.

If the user determines that more air is needed to aerate the liquid/foam solution (28), the user simply inserts a screwdriver into slot (35) and turns member (34) clockwise (which causes the second member "34" to enter further into the mixing chamber "14", whereby, increasing the vacuum action until the desired flow and/or air mixture is achieved. Once the user has determined the proper setting for the aeration means (30), they simply tighten nut (40) until it rests and locks into position upon the second end of the first member 32, whereby, locking the aeration means (30) into position at the desired location of choice.

It is to be noted that the aeration means (30) is adjustable between a first closed position (shown in FIG. 5), and a second open position (shown in FIG. 6), which therefore allows the user to adjustably control the liquid/air flow (somewhere between said positions) until the proper liquid/air combination of choice is determined and accomplished.

It will now be seen that we have herein provided a functional, economical, "LIQUID/FOAM/MIXING/AERATION ADAPTER APPARATUS" which expels a combination liquid/foam solution in a controlled manner therefrom, and which is universally attachable to various sized nozzles of choice.

It will further be seen that we have herein provided a "LIQUID/FOAM/MIXING/AERATION ADAPTER APPARATUS" which is frictionally attachable to various sized nozzles of choice, such as a nozzle which is mounted at the front end of a body of a hand manipulated pumping apparatus, or the like.

It will also be seen that we have herein provided a "LIQUID/FOAM/MIXING/AERATION ADAPTER APPARATUS" which is made from a flexible material, such as a rubber hose, or the like.

It will now be seen that we have herein provided a "LIQUID/FOAM/MIXING/AERATION ADAPTER APPARATUS" which includes a tubular insert therein for expelling a combination liquid/foam/air solution in a controlled manner therefrom.

It will also be seen that we have herein provided a "LIQUID/FOAM/MIXING/AERATION ADAPTER APPARATUS" which includes a flexible member having at least two substantially opposed angular cavities through substantially its side wall, with each cavity being in open communication with the mixing chamber formed within the flexible member and each cavity being so angled (by engineering choice) so as to provide the most efficient aeration possible.

It will still further be seen that we have herein provided a unique aeration means which may be inserted within the flexible tubular member, (either at the point of manufacture or by the user) and which allows the user to adjust the air flowing entering the mixing chamber. It is to be noted that the present invention is functional without the aeration means inserted therein, and therefore the aeration means is substantially an accessory item for the present invention.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by Letters Patent is:

1. A liquid/foam/mixing/aeration adapter apparatus comprising; an elongated flexible tubular member which forms a mixing chamber therein for receiving and directing a liquid/foam/air solution therefrom, said member having first and second open ends, said first end being frictionally attachable over a nozzle, said second end being of a shape and size to frictionally receive therein a tubular insert for expelling said liquid/foam/air solution therefrom, said member having at least two substantially opposed angular bores for receiving aeration means there through with said bores being in open communication with said chamber, said aeration means comprising; first and second tubular members each having first and second ends, said first tubular member being of a size and shape to be threadably engaged within one of said bores, said first tubular member being of a size and shape to threadably adjustably receive said second tubular member there through, said second tubular member being of a length to extend substantially half way into said chamber, said second end of said second tubular member being of a size and shape to threadably receive a nut thereon and said second end of said first tubular member acting as a stop means for said nut, whereby; said aeration means is adjustable.

2. The adapter of claim 1 wherein said flexible tubular member is a rubber hose.

3. The adapter of claim 1 wherein said second end of said second tubular member includes a slot for receiving a screw driver tip therein.

* * * * *